United States Patent [19]

Peterman

[11] 4,218,837

[45] Aug. 26, 1980

[54] HIGH LIFT HYDRAULIC SYSTEM FOR AN EXCAVATOR

[75] Inventor: Robert J. Peterman, Radnor, Pa.

[73] Assignee: Koehring Company, Brookfield, Wis.

[21] Appl. No.: 934,720

[22] Filed: Aug. 21, 1978

[51] Int. Cl.[3] ..... E02F 3/32

[52] U.S. Cl. ..... 37/103; 414/685

[58] Field of Search ..... 37/103, DIG. 9, DIG. 3, 37/117.5; 414/699, 685; 91/418, 419, 442, 461; 137/561 R, 624.27, 625.6, 625.63

[56] References Cited

U.S. PATENT DOCUMENTS

| | | | |
|---|---|---|---|
| 2,969,844 | 1/1961 | Hamrick | 37/DIG. 3 |
| 3,583,585 | 6/1971 | Joyce | 37/103 X |
| 3,584,751 | 6/1971 | Bellart | 37/103 X |
| 3,606,049 | 9/1971 | Gordon | 414/699 |
| 3,874,532 | 4/1975 | Metailler | 37/103 X |
| 3,883,023 | 5/1975 | Bernhoft | 414/699 |
| 3,922,745 | 12/1975 | Lehman | 37/103 X |
| 3,934,742 | 1/1976 | Tennis | 414/699 |
| 4,044,610 | 8/1977 | Oldaeus et al. | 414/685 |

FOREIGN PATENT DOCUMENTS

| | | | |
|---|---|---|---|
| 885292 | 11/1971 | Canada | 37/103 |
| 1403046 | 8/1975 | United Kingdom | 414/699 |

*Primary Examiner*—E. H. Eickholt

*Attorney, Agent, or Firm*—Burns, Doane, Swecker & Mathis

[57] ABSTRACT

The disclosure relates to an apparatus for increasing the lifting capacity of the boom of an excavator to lift heavy objects, while conjointly disabling the hydraulic circuit used for normal digging operations to avoid damaging the excavator. The apparatus includes a manually operated pilot valve for selectively applying a control fluid pressure to a relief valve for a hoist cylinder and a to relief valve for a digging bucket cylinder. The control fluid pressure biases the hoist relief valve to remain closed at hydraulic pressures above the normal relief pressure of the valve, and conjointly biases the bucket relief valve to open, thereby disabling the bucket.

8 Claims, 2 Drawing Figures

HIGH LIFT HYDRAULIC SYSTEM FOR AN EXCAVATOR

BACKGROUND OF THE INVENTION

The present invention relates to an hydraulic apparatus for temporarily increasing the lifting capacity of an excavator.

Hydraulic excavators typically include a boom which is pivoted by a hoist cylinder with respect to the excavator chassis so that an outer portion of the boom moves in a vertical arc. A digging bucket is coupled to the boom, usually by means of an arm pivotably attached to the outer end of the boom. In normal operation the bucket, arm and boom are pivoted with respect to one another so that the bucket moves toward the excavator chassis to scoop up earth or other material.

Hydraulic excavators are also, occasionally, used to lift heavy objects such as sewer pipes, structural components or dirt shields. When the excavator is employed by this secondary lifting function, the excavator bucket is typically disabled. The lifting capacity of the excavator is limited principally by the maximum pressure applied to a hoist cylinder which pivots the excavator boom. This capacity may be insufficient to lift some heavy objects.

Various hydraulic control systems for excavators are known in the prior art. One such control system, shown in U.S. Pat. No. 3,865,013 to Mastaj, provides a relatively complex hydraulic interlock for a tractor mounted pavement breaker. The system prevents the hydraulic pavement breaker from being lifted off the work by a hydraulic boom of the tractor while the pavement breaker is being operated. However, pressure relief valves rather than interlock systems such as the Mastaj system are often employed to limit the operation of excavator hydraulic rams. A pressure relief valve system for use with a hoist or lifting cylinder of an excavator is disclosed, for example, in U.S. Pat. No. 3,324,881 to Keir.

An adjustment mechanism for the relief valve of the hoist cylinder of an excavator could be provided to permit the operator to selectively increase the maximum pressure applied to the hoist cylinder. Experience has indicated however, that operators typically run excavators at maximum capacity for as much of the time possible. It is expectable, then, that a readily adjustable relief valve for a hoist cylinder would be set to its upper pressure limit by the operator and would be left at that setting. As a consequence, the hoist cylinder would be operated at the increased capacity much of the time. As a general rule of thumb, an increase of ten percent in the maximum fluid pressure applied to a hydraulically actuated system in an excavator, cuts the lift expectancy of the system in half. Thus, the use of the hoist cylinder at an increased capacity during normal excavator operations will tend to shorten the life of the excavator and risks injury to personnel associated with the excavator should the excavator fail catastrophically.

A known apparatus for increasing the lifting capacity of an excavator provides for an increase in the maximum pressure applied to the hoist cylinder while reducing the volume output of the hydraulic system, thus reducing the speed of the rams powered by the hydraulic system. The apparatus has the disadvantage that the lifting speed of the excavator is reduced. Moreover, the excavator can be misused to perform slow digging with the bucket at increased hydraulic pressures. Thus, the excavator could, for example be used to slowly excavate large rocks which could not be moved if the excavator were operated at normal hydraulic pressures. Such operation could damage the excavator.

Accordingly, it is an object of the present invention to provide an apparatus for increasing the lifting capacity of an excavator for use in lifting heavy objects, while conjointly disabling the hydraulic circuit used for normal digging operations.

It is another object of the present invention to provide as easily and inexpensively fabricated apparatus for increasing the lifting capacity of an excavator while enabling the excavator boom to be pivoted at normal speed.

These and other objects and features of the invention will become apparent from the claims and from the following description when read in conjunction with the accompanying drawings.

THE FIGURES

DETAILED DESCRIPTION

This disclosure relates to an apparatus for temporarily increasing the lifting capacity of an hydraulic excavator. Typically, an hydraulic excavator has a main lift boom pivotable about a horizontal pivot axis. An hydraulic hoist cylinder may be provided for raising and lowering an outer portion of the main lift boom. A bucket arm may be pivoted about a horizontal axis at the outer end portion of the main lift boom. A bucket for pushing or scooping earth or other excavated material may be pivoted about an outer end portion of the bucket arm by an hydraulic bucket cylinder.

The excavator may have a first hydraulic circuit including the hydraulic hoist cylinder and a manually operated hoist control valve for controlling flow of a pressurized fluid to the hoist cylinder. A second hydraulic circuit may be provided including the hydraulic bucket cylinder and a manually operated bucket control valve for controlling the flow of pressurized fluid to the bucket cylinder. A dual position hoist relief valve, connected to the first hydraulic circuit may be normally biased to open when fluid pressure applied to the hoist cylinder exceeds a first preset pressure, to thereby prevent pressure applied to the hoist cylinder from exceeding a first preset pressure. A dual position, bucket relief valve, connected to the second hydraulic circuit may be normally biased to open when fluid pressure applied to the bucket cylinder exceeds a maximum operating pressure. A manually operated pilot valve may be provided for selectively opening the bucket relief valve and, conjointly, biasing the hoist relief valve to open when fluid pressure applied to the hoist cylinder exceeds a second preset pressure, greater than the first present pressure.

Figure 1:
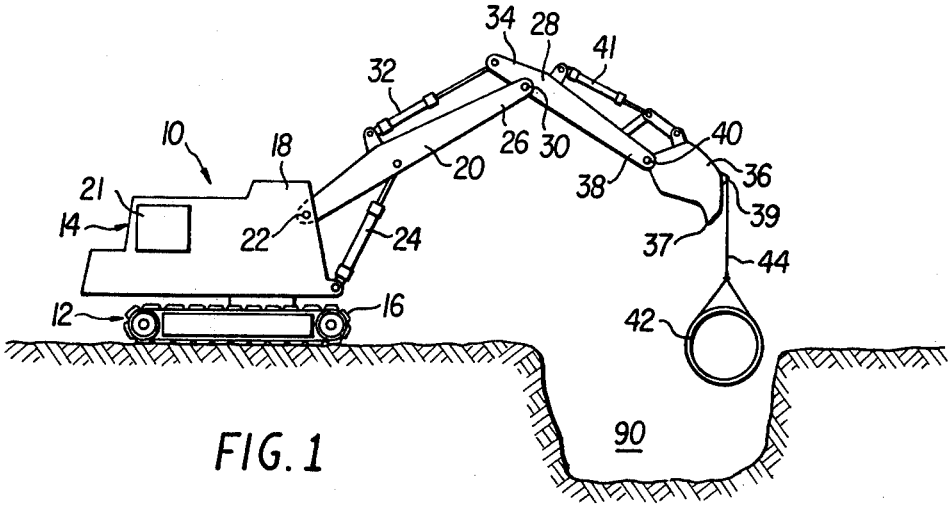
FIG. 1 is a pictorial view showing an excavator employed to lift an object.

Referring now to FIG. 1, there is shown a bucket type excavator denoted generally by the number 10. The excavator may have an undercarriage 12 and an upper structure 14, the latter being mounted to the former so that the upper structure may pivot about a vertical axis.

The undercarriage 12 may include ground engaging tracks 16 for moving the excavator from place to place. The upper structure 14 may include a cab for the operator and the excavator controls. A propulsion unit, including an engine for driving an hydraulic pump, may be located in the position designated by the number 21 at the rear of the upper structure.

A main lift boom 20 is pivotably mounted to the upper structure 14 for pivoting about a horizontal pivot axis 22. For pivoting the boom to raise and lower an end portion of the boom, an hydraulic cylinder 24 is connected between the upper structure 14 and the boom 20.

A bucket arm 28 is pivotably mounted to the outer portion 26 of the boom 20 for pivoting about a substantially horizontal axis 30. A bucket arm hydraulic cylinder 32 is connected between the boom 20 and an end portion 34 of the bucket arm adjacent the pivoting axis 30 on the opposite end of the bucket arm from the excavator bucket 36. The bucket arm ram 32 functions to pivot the bucket arm 28 with respect to the main boom 20.

The bucket 36 is pivotably mounted on an outer portion 38 of the bucket arm 28 and is pivoted about a substantially horizontal axis 40 by a bucket cylinder 41.

In normal operation, the hoist, bucket arm and bucket cylinders are actuated to dig an end 37 of the bucket into the earth. In so doing, the main boom, bucket arm and bucket are moved with respect to each other in fashion similar to the bending of an index finger. The bucket may be further pivoted to scoop out a portion of the earth in its path.

In FIG. 1, the excavator 10 is shown lifting an object, specifically, a section of pipe 42. Advantageously, the section of pipe 42 may be lashed to an attachment eye 39 on the back of the bucket 36 by means of a cable 44. In performing the lifting operations, the section of pipe 42 is lifted principally by the force exerted by the hoist cylinder 24.

The excavator of FIG. 1 can be employed to bury pipe. When so employed, the excavator may be operated for some period of time, typically 20 to 45 minutes, to dig a hole 90 for receiving a section of pipe. Upon completion of this digging, the excavator may be employed to lift a section of pipe from a storage point, carry the section of pipe to the newly excavated hole, and lower and position the section of pipe in the hole.

Figure 2:
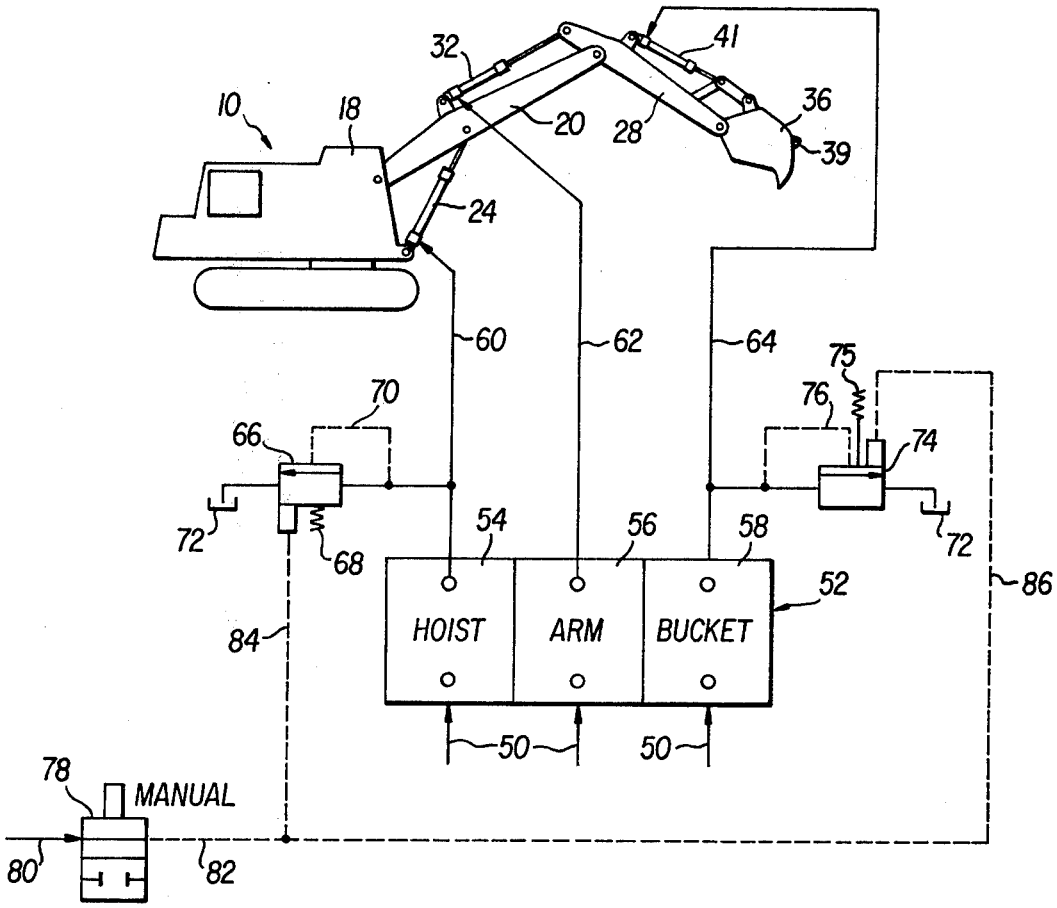
FIG. 2 is a schematic diagram of an embodiment of the present invention for increasing the lifting capacity of an excavator.

FIG. 2 is a schematic diagram of an embodiment of the present invention for increasing lifting capacity of an excavator. In FIG. 2, and excavator similar to that shown in FIG. 1 is described, wherein like structures are identified by the same numbers as in FIG. 1. The main boom 20, the bucket arm 28 and the bucket 36 of the excavator 10 are operated by the hydraulic cylinders 24, 32 and 41, in the same manner as discussed in connection with FIG. 1. It should be understood, however, that while the preferred embodiment is described in connection with an excavator having a single hoist cylinder, a single bucket arm cylinder and a single bucket cylinder 41, more than one hydraulic motor may be employed to perform the functions attributed to the single rams described in connection with FIG. 1. The cylinders 24, 32 and 41 may be of conventional design, each including a piston rod assembly. The cylinders are driven by fluid pumped from a fluid reservoir into main supply conduits 50.

A conventional master control valve for the hydraulic system of the excavator is denoted generally by the numeral 52. The master control valve 52 consists of a control valve 54 for the hoist, a control valve 56 for the bucket arm cylinder 32 and a control valve 58 for the bucket cylinder 41. Fluid from one of the main supply conduits 50 is selectively directed to the hoist cylinder 24 via conduit 60. Likewise, fluid is selectively directed by the arm control valve 56 to the bucket arm cylinder 32, via conduit 62, and fluid is directed by the bucket control valve 58 to the bucket cylinder 41, via conduit 64. Advantageously, the control valves 54, 56 and 58 may be three position valves having a first position for delivering fluid to their respective cylinders to extend the piston rod of the cylinders. In a second position, fluid may be applied to the cylinders through conduits not shown in the Figure, to retract the piston rods. Finally, when the three position valve is in a neutral position, fluid may be directed through the control valve and returned to the fluid reservoir through conduits not shown in the Figure.

A dual position hoist relief valve 66 is connected to the conduit 60. The hoist relief valve 66 is normally biased by a spring 68 to open when a control fluid pressure, applied through conduit 70 and equal to the pressure in the conduit 60, exceeds a first preset pressure. When fluid pressure in the conduit 60 exceeds the first preset pressure the hoist relief valve 66 opens and returns fluid to the reservoir 72, thereby preventing pressure applied to the hoist cylinder from exceeding the preset pressure. The arm cylinder may also be provided with a relief valve (not shown).

In a similar manner, a dual position, bucket relief valve 74 is connected to the conduit 64 to prevent the fluid pressure applied to the bucket cylinder from exceeding a maximum operating pressure. The bucket relief valve 74 is normally biased closed by a spring 75. When fluid pressure in a control line 76, equal to the fluid pressure in the conduit 64, exceeds the maximum operating pressure, the bucket relief valve opens and conducts fluid to the reservoir 72, thereby preventing pressure in the bucket cylinder from exceeding the maximum operating pressure.

A manually operated pilot valve system is provided for selectively opening the bucket relief valve 74 and, conjointly, biasing the hoist relief valve 66 to open when fluid pressure applied to the hoist cylinder 24 exceeds a second preset pressure, greater than the first preset pressure. Advantageously, the second preset pressure is at least 15 percent greater than the first preset pressure, so that a substantially greater lifting capacity is provided.

The pilot valve system includes a manually operated pilot valve 78 located in the cab 18 of the excavator so that it may be conveniently actuated by the excavator operator when increased lifting capacity is required. Fluid pressure is applied to the pilot valve 78 by a pilot valve supply conduit 80. When the pilot valve 78 is manually opened, fluid from the supply conduit 80 is directed through a control conduit 82 having two branches 84 and 86 connected to the hoist relief valve and the bucket relief valve, respectively. Fluid pressure in the conduit 84 biases the hoist relief valve 66 to increase the relief pressure thereof. Fluid pressure in the conduit 86 biases the bucket relief valve 74 to reduce the maximum operating pressure which may be applied to the bucket cylinder 41. Advantageously, the pressure applied via the conduit 86 biases the bucket relief valve 74 to open causing the piston of bucket cylinder 41 to bottom thereby preventing the bucket 36 from being pivoted by the bucket cylinder 41. The bucket is thus disabled from performing its working function.

In operation the excavator may be used to dig in the conventional manner, for example, to dig a hole 90 in which to bury a sewer pipe. During the period when the excavator is used for digging, the pilot valve 78 would be closed so that fluid pressure, not exceeding the first preset pressure, may be applied to the hoist cylinder 24 during the digging, and so that the bucket cylinder 41 and relief valve 74 operate in their normal fashion. When the digging operation is complete, as when the hole 90 is of sufficient size and depth to properly receive a section of pipe 42, the operator may actuate the pilot valve 78 in the excavator cab 18. The excavator may then be moved to a location where pipe sections are temporarily stored at which time a pipe section may be coupled to the disabled bucket of the excavator and lifted by applying fluid pressure to hoist cylinder 24 by means of the hoist control valve 54. By reason of the biasing of the hoist relief valve 66 to a higher relief pressure, the excavator may be operated with greater lifting capacity to enable it to lift heavy pipe sections.

The excavator may then be positioned over the hole 90 and the pipe section lowered and positioned in the hole. However, normal digging operations cannot proceed before the operator has closed the pilot valve 78, since the bucket 36 and bucket cylinder 41 have been disabled. Accordingly, in order to resume digging, the operator must close the pilot valve and thereby unbias the hoist relief valve 66 from the increased relief pressure. In this way, the lifting capacity of the excavator is increased while inhibiting prolonged use of the excavator for normal digging operations while the lifting capacity of the hydraulic hoist is increased. It will be readily understood that the present invention may be practiced in many applications where increased lifting capacity is required, and not used merely in connection with burying pipe.

The principles, preferred embodiments and modes of operation of the present invention have been described in the foregoing specification. The invention which is intended to be protected is not, however, to be construed as limited to the practical forms disclosed, since these are to be regarded as illustrative rather than restrictive. Variations and changes may be made by those skilled in the art without departing from the spirit and scope of the present invention.

What is claimed is:

1. An apparatus for temporarily increasing the lifting capacity of an hydraulic excavator having a main lift boom pivotably about a horizontal pivot axis, a bucket arm pivoted about an axis at an outer end portion of the main lift boom and a bucket pivotably mounted at an outer end portion of the bucket arm, said apparatus comprising:

a first hydraulic circuit including:

an hydraulic hoist cylinder connected to the main lift boom and;

a manually operated hoist control valve for controlling flow of a pressurized fluid to said hoist cylinder;

a second hydraulic circuit including:

a hydraulic bucket cylinder connected between the bucket arm and the bucket for pivoting the bucket with respect to the arm; and, a manually operated bucket control valve for controlling flow of the pressurized fluid to said bucket cylinder;

a dual position hoist relief valve connected to said first hydraulic circuit and normally biased to open when fluid pressure applied to said hoist ram exceeds a first preset pressure to thereby prevent pressure applied to said hoist cylinder from exceeding the first preset pressure;

a dual position bucket relief valve connected to said second hydraulic circuit and normally biased to open when fluid pressure applied to said bucket cylinder exceeds a maximum operating pressure to thereby prevent pressure in said bucket cylinder from exceeding the maximum operating pressure; and a manually operated pilot valve means for selectively opening said bucket relief valve to prevent the bucket from pivoting and, conjointly biasing said hoist relief valve to remain closed until fluid pressure applied to said hoist cylinder exceeds a second preset pressure, greater than the first preset pressure.

2. The apparatus of claim 1 wherein the manually operated pilot valve means is located in a cab of the excavator.

3. The apparatus of claim 1 wherein the hoist relief valve is normally biased closed by a spring and wherein said pilot valve selectively provides a hydraulic fluid force in opposition to a force exerted by the spring to prevent the hoist relief valve from opening until the fluid pressure applied to said hoist ram exceeds the second preset pressure.

4. The apparatus of claim 3 wherein said pilot valve selectively provides the hydraulic fluid force to the bucket reflief valve to open the bucket relief valve.

5. The apparatus of claim 1 wherein the second preset pressure is at least 15 percent greater than the first preset pressure.

6. In an hydraulic excavator having a main lift boom pivoted about a horizontal axis by an hydraulic hoist cylinder to raise and lower an output portion of the main lift boom, the hydraulic hoist cylinder being connected to a hoist relief valve biased to prevent fluid pressure in the hoist cylinder from exceeding a preset pressure; and having a bucket coupled to the main lift boom and pivoted by an hydraulic bucket cylinder, the hydraulic bucket cylinder being connected to a bucket relief valve biased to prevent pressure in the bucket cylinder from exceeding a maximum operating pressure; an apparatus for increasing the lifting capacity of the hydraulic hoist cylinder while inhibiting use of the excavator for normal digging operations with the bucket while the lifting capacity of the hydraulic hoist cylinder is increased comprising, first biasing means for selectively biasing the bucket relief valve to reduce the maximum operating pressure applied to the bucket; second means for biasing the hoist relief valve to increase the preset pressure; and a manually operated pilot valve for simultaneously actuating said first and second biasing means.

7. An apparatus for temporarily increasing the lifting capacity of an hydraulic excavator having a main lift boom pivoted about a horizontal axis by an hydraulic hoist cylinder to raise and lower an outer portion of the main lift boom, the hydraulic hoist cylinder being connected to a hoist relief valve biased to prevent fluid pressure in the hoist cylinder from exceeding a preset pressure; and having a tool coupled to the main lift boom and pivoted by an hydraulic tool cylinder, the hydraulic tool cylinder being connected to a tool relief valve biased to prevent pressure in the tool cylinder from exceeding a maximum operating pressure; and a manually operable control, coupled to said relief valves, which conjointly increases the preset pressure and reduces the maximum operating pressure which may be applied to the tool cylinder.

8. The apparatus of claim 7 further comprising attachment means for securing an auxiliary load to the tool, said attachment means being located off the axis of pivoting of the tool; whereby, the attachment means is positioned relative to the pivot axis of the tool by pivoting the tool.

* * * * *